US010227763B2

(12) United States Patent
Montjoy

(10) Patent No.: US 10,227,763 B2
(45) Date of Patent: Mar. 12, 2019

(54) VAGINAL SHIELD ASSEMBLY

(71) Applicant: Deanna M. Montjoy, Inglewood, CA (US)

(72) Inventor: Deanna M. Montjoy, Inglewood, CA (US)

( * ) Notice: Subject to any disclaimer, the term of this patent is extended or adjusted under 35 U.S.C. 154(b) by 812 days.

(21) Appl. No.: 14/633,786

(22) Filed: Feb. 27, 2015

(65) Prior Publication Data

US 2015/0167281 A1 Jun. 18, 2015

Related U.S. Application Data

(63) Continuation-in-part of application No. 13/465,347, filed on May 7, 2012, now Pat. No. 8,873,680.

(51) Int. Cl.
*E03D 9/00* (2006.01)

(52) U.S. Cl.
CPC ..... *E03D 9/00* (2013.01)

(58) Field of Classification Search
CPC ..... A61M 25/02
USPC ..... 128/846; 600/184, 185, 190, 196; 604/310, 289, 19
See application file for complete search history.

(56) References Cited

U.S. PATENT DOCUMENTS

| | | | | |
|---|---|---|---|---|
| 1,614,065 | A * | 1/1927 | Guttmann | 600/235 |
| 4,734,941 | A | 4/1988 | DeWitt et al. | |
| D363,987 | S | 11/1995 | Hollifield et al. | |
| D371,601 | S | 7/1996 | Markles | |
| 5,699,614 | A * | 12/1997 | Garneau, Sr. | 30/142 |
| D393,061 | S | 3/1998 | Mandich et al. | |
| 5,960,481 | A | 10/1999 | Deveer | |
| 6,151,972 | A | 11/2000 | Venter et al. | |
| 7,465,295 | B2 * | 12/2008 | Bergeron et al. | 604/279 |
| 2004/0181862 | A1 | 9/2004 | Brummer et al. | |
| 2005/0130818 | A1 * | 6/2005 | Karol | 482/148 |
| 2009/0056003 | A1 | 3/2009 | Ivie et al. | |
| 2013/0006264 | A1 * | 1/2013 | Klebanoff | 606/124 |

* cited by examiner

*Primary Examiner* — Tarla R Patel

(57) ABSTRACT

A vaginal shield assembly includes an elongated handle that has a first end and a second end. A splash guard is attached to the second end. The splash guard has a width greater than 1.5 inches and a length greater than 3 inches. The splash guard is configured to be positioned over a vagina to prevent fluids from splashing on or adjacent to the vagina when a user of the assembly is using a toilet.

8 Claims, 3 Drawing Sheets

VAGINAL SHIELD ASSEMBLY

I hereby claim the benefit under Title 35, United States Code, Section 120 of U.S. application Ser. No. 13/465,347 filed Apr. 26, 2012, of which this application is a continuation in part.

BACKGROUND OF THE DISCLOSURE

Field of the Disclosure

The disclosure relates to splash guard devices and more particularly pertains to a new splash guard device for protecting a vaginal opening from toilet contaminants which might otherwise cause infections.

SUMMARY OF THE DISCLOSURE

An embodiment of the disclosure meets the needs presented above by generally comprising an elongated handle that has a first end and a second end. A splash guard is attached to the second end. The splash guard has a width greater than 1.5 inches and a length greater than 3 inches. The splash guard is configured to be positioned over a vagina to prevent fluids from splashing on or adjacent to the vagina.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
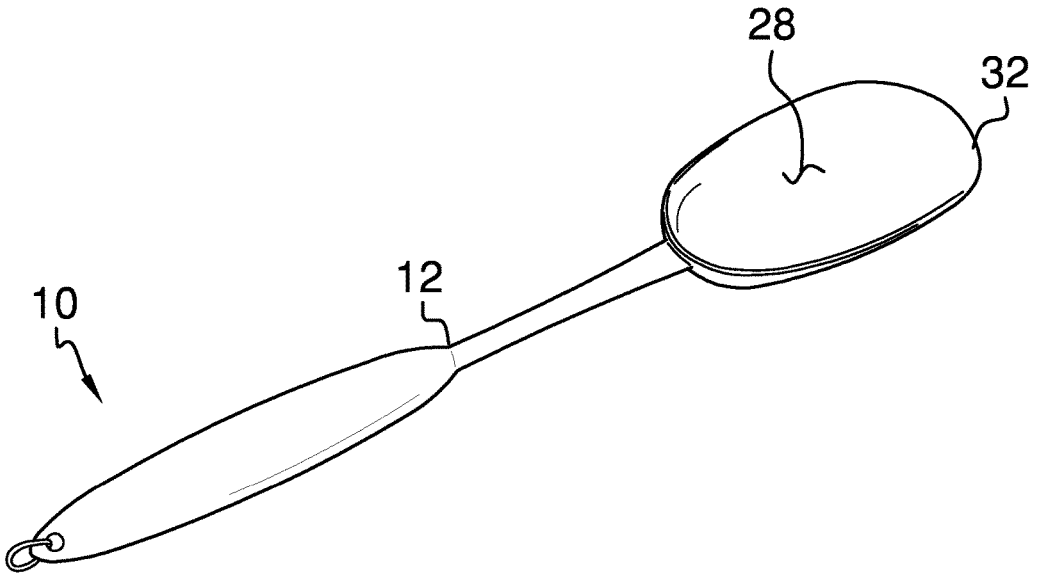
FIG. 1 is a top perspective view of a vaginal shield assembly according to an embodiment of the disclosure.
Figure 2:
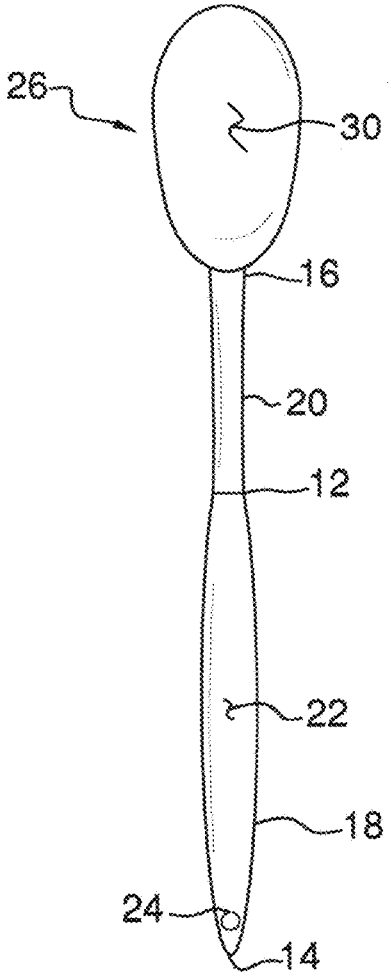
FIG. 2 is a bottom view of an embodiment of the disclosure.
Figure 3:
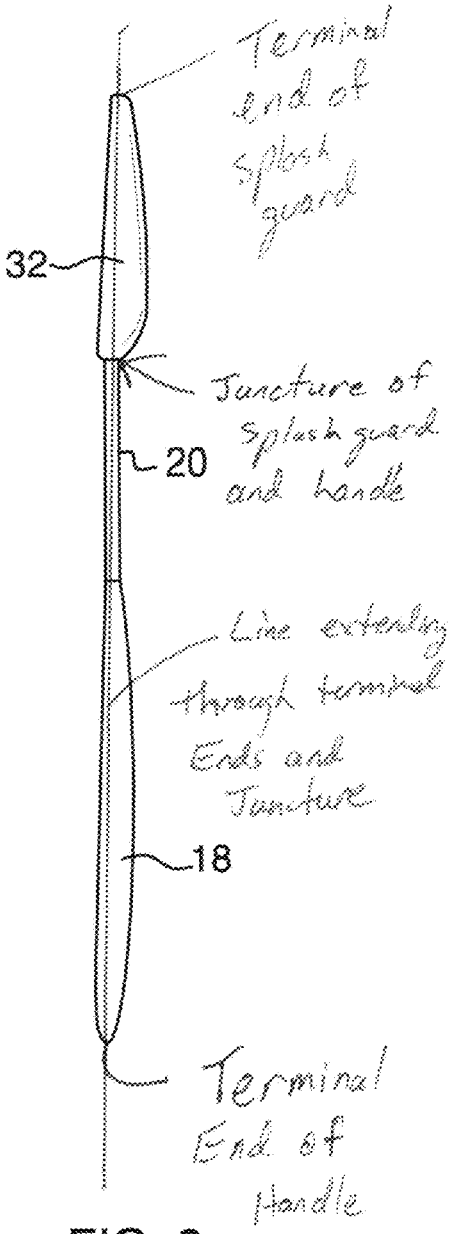
FIG. 3 is a side view of an embodiment of the disclosure.

With reference now to the drawings, and in particular to FIGS. 1 through 5 thereof, a new splash guard device embodying the principles and concepts of an embodiment of the disclosure and generally designated by the reference numeral 10 will be described.

Figure 4:
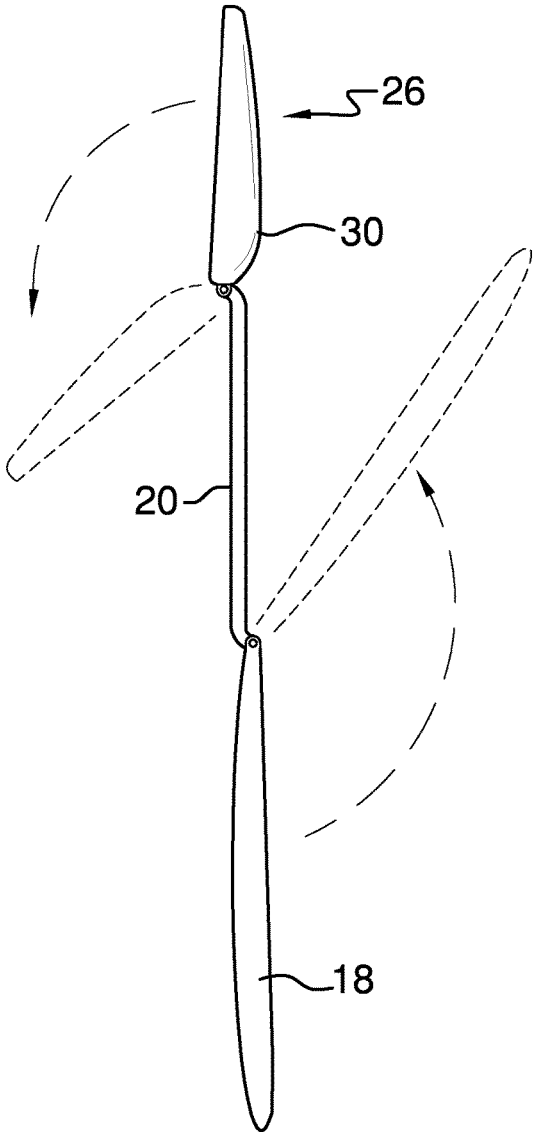
FIG. 4 is a side view of an embodiment of the disclosure.
Figure 5:
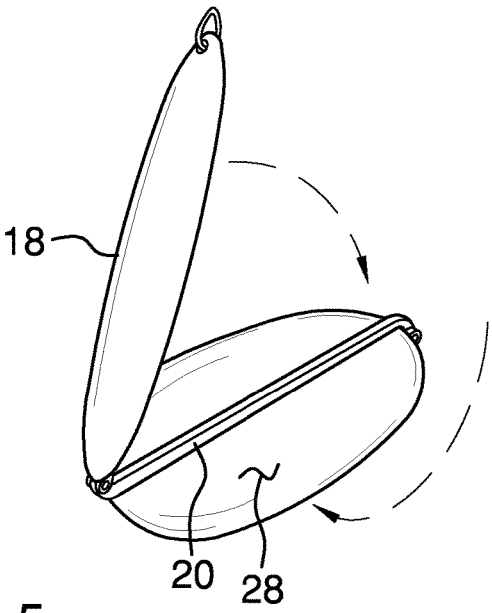
FIG. 5 is a perspective bottom view of an embodiment of the disclosure.

As best illustrated in FIGS. 1 through 5, the vaginal shield assembly 10 generally comprises an elongated handle 12 that has a first end 14 and a second end 16. The handle 12 includes a first portion 18 including the first end 14 and a second portion 20 including the second end 16. The first portion 18 has a central area 22 having a width greater than 0.75 inches and more particular may have a width equal to about 1.0 inches. The first portion 18 defines a grip. The second portion 20 has a width smaller than 0.75 inches and more particularly may have width equal to about 0.5 inches. The first 18 and second 20 portions, as shown in FIGS. 4 and 5, may be pivotally coupled to each other. Each of the first 18 and second 20 portions has a length greater than 4.0 inches and may have a length each equal to about 5.0 inches. An aperture 24 may be extended through the handle 12 adjacent to the first end 14.

A splash guard 26 is attached to the second end 16. The splash guard 26 has a width greater than 1.5 inches and a length greater than 3.0 inches. More particularly, the splash guard 26 may have a length up to 6.0 inches. The splash guard 26 has an upper surface 28, a lower surface 30 and a perimeter edge 32 extending between the upper 28 and lower 30 surfaces. The upper surface 28 is planar and is oblong. The lower 30 surface is convexly arcuate and the perimeter edge 32 is convexly arcuate from the upper surface 28 to the lower surface 30. The splash guard 26 may be pivotally coupled to the second end 16 as shown in FIGS. 4 and 5. This allows the splash guard 26 and the first portion 18 to each be folded onto the second portion 20 to define a stored condition.

In use, before defecating, a user grips the elongated member 12 adjacent to the first end 14 and positions the splash guard 26 over their vagina. The splash guard 26 is positioned over an opening to the vagina to prevent fluids from a toilet from splashing onto the vagina or areas adjacent to the vagina. Also, the splash guard 26 may be positioned beneath the urethra and over an opening to the vagina during urination. In either case, when human waste strikes the water in a toilet bowl a splash will be created which will cause contaminated water particles to strike the person using the toilet. The splash guard 26 prevents this contaminated water from striking the vagina where it might cause an infection.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method to block a vaginal area from water splashing from a toilet, said method including the steps of:

providing a shield assembly including:

an elongated handle having a first end and a second end, said splash guard has an upper surface, a lower surface and a perimeter edge extending between said upper and lower surfaces, said upper surface being planar;

a splash guard being attached to said second end, said splash guard having a width greater than 1.5 inches and a length greater than 3 inches, said handle and said splash guard each having a terminal end positioned opposite of each other, a straight line being extendable through said terminal ends such that said straight line intersects a juncture of said handle and said splash guard;

said upper surface being oblong such that said splash guard is elongated from said handle to said terminal end of said splash guard; and positioning said splash guard over a vagina while using a toilet to prevent from the toilet from splashing on or adjacent to the vagina.

2. The method to block a vaginal area from water splashing from a toilet according to claim 1, wherein said handle includes a first portion including said first end and a second portion including said second end, said first portion having a central area having a width greater than 0.75 inches and defining a grip, said second portion having a width smaller than 0.75 inches.

3. The method to block a vaginal area from water splashing from a toilet according to claim 2, wherein said first and second portions are pivotally coupled to each other.

4. The method to block a vaginal area from water splashing from a toilet to claim 3, wherein said splash guard is pivotally coupled to said second end.

5. The method to block a vaginal area from water splashing from a toilet according to claim 2, wherein each of said first and second portions has a length greater than 4.0 inches.

6. The method to block a vaginal area from water splashing from a toilet according to claim 1, wherein said perimeter edge is convexly arcuate from said upper surface to said lower surface.

7. The method to block a vaginal area from water splashing from a toilet according to claim 1, wherein said splash guard is pivotally coupled to said second end.

8. A method to block a vaginal area from water splashing from a toilet, said method including the steps of:

providing a shield assembly including:

an elongated handle having a first end and a second end, said handle including a first portion including said first end and a second portion including said second end, said first portion having a central area having a width greater than 0.75 inches and defining a grip, said second portion having a width smaller than 0.75 inches, said first and second portions being pivotally coupled to each other, each of said first and second portions having a length greater than 4.0 inches;

a splash guard being attached to said second end, said splash guard having a width greater than 1.5 inches and a length greater than 3 inches, said splash guard having an upper surface, a lower surface and a perimeter edge extending between said upper and lower surfaces, said upper surface being planar and being oblong, said lower surface being convexly arcuate, said perimeter edge being convexly arcuate from said upper surface to said lower surface, said handle and said splash guard each having a terminal end positioned opposite of each other, a straight line being extendable through said terminal ends such that said straight line intersects a juncture of said handle and said splash guard;

said splash guard being pivotally coupled to said second end; and positioning said splash guard over a vagina while using a toilet to prevent from the toilet from splashing on or adjacent to the vagina.

* * * * *